US005416503A

United States Patent [19]

Ishijima et al.

[11] Patent Number: 5,416,503

[45] Date of Patent: May 16, 1995

[54] THERMAL HEAD CONTROLLER

[75] Inventors: Michio Ishijima; Takaya Nagahata, both of Kyoto, Japan

[73] Assignee: Rohm Co., Ltd., Kyoto, Japan

[21] Appl. No.: 212,809

[22] Filed: Mar. 15, 1994

[30] Foreign Application Priority Data

Apr. 2, 1993 [JP] Japan ..... 5-076858

[51] Int. Cl.[6] ..... B41J 2/38; B41J 2/35

[52] U.S. Cl. ..... 347/ 211 H; 400/120

[58] Field of Search ..... 346/76 PH, 76 R, 76 L, 346/107 R, 108, 140 PD; 400/120; 347/60

[56] References Cited

U.S. PATENT DOCUMENTS 4,568,817 2/1986 Leng et al. ..... 346/76 PH 4,963,884 10/1990 Kiguchi et al. ..... 346/76 PH

*Primary Examiner*—Huan Tran

*Attorney, Agent, or Firm*—Fish & Richardson

[57] ABSTRACT

An electric erosion can be prevented from occurring in a thermal head when a bias voltage is being applied to the thermal head on non-printing. When the bias voltage is being applied to heating resistance elements in the thermal head on non-printing, a motor drive circuit causes a motor to rotate a platen roller so that a heat-sensitive medium will be delicately moved to change the moisture on the surfaces of the heating resistance elements. Alternatively, preliminary pulses may be intermittently applied to a driver IC through a head drive circuit to energize the heating resistance elements sufficiently not to color the heat-sensitive medium so that the moisture on the surfaces of the heating resistance elements will be evaporated to avoid the electric erosion in the thermal head.

5 Claims, 2 Drawing Sheets

THERMAL HEAD CONTROLLER

BACKGROUND OF THE INVENTION

1Field of the Invention

The present invention relates to an apparatus for controlling a thermal head, such as may be used in a facsimile or thermal printer.

2. Description of the Related Art

In general, the thermal head performs the printing by selectively energizing a plurality of heating elements to color a heat-sensitive sheet of paper. Each of the heating elements may include a heating resistance element and common and IC leads which are used as electrodes connected to the heating resistance element. The common lead is used to apply a bias voltage to the heating resistance element while the IC lead is connected to a driver IC which is turned on or off for each pixel in response to a print signal. As the bias voltage is being applied to the heating resistance element, the driver IC is selectively driven by the print signal to energize the heating resistance element.

When the bias voltage is being applied to the thermal head under a condition of high temperature/humidity, there may be produced a break-down known as "electric erosion" by which the electrodes and heating resistance elements are eroded by an electrochemical reaction.

Such an electric erosion will be described with reference to FIG. 4. A thermal head shown in FIG. 4 comprises a substrate 1, a resistor 2 formed on the substrate 1 and common and IC leads 3, 4 similarly formed on the substrate 1. The resistor and parts of the leads are coated with an overcoat glass 5. The IC lead 4 is connected to a driver IC 6. A heat-sensitive sheet of paper 7 is moved by a platen roller 8 while contacting the overcoat glass 5. The resistor 2 may be made of $RuO_2$ while the common and IC leads 3, 4 may be formed of Au.

The mechanism of electric erosion is believed to be as follows. The heat-sensitive sheet 7 may contain Cl ions or Na ions. The Cl ions may pass through the mesh structure of the protective film or overcoat glass 5 to the resistor 2 by the aid of $H_2O$. The Cl ions then reach the gold patterns (leads 3 and 4) which are electrically conductive. The mixture of $Cl+H_2$ creates an electrolytic reaction at the electrode parts of the gold patterns so that the gold will migrate to the heat-sensitive sheet 7. Such a reaction proceeds with increasing speed until the gold patterns are broken. At the same time, a pin hole or holes may be formed in the protective film. The electrochemical reaction is believed to include the following reactions produced in parallel with each other:

$$Cl^- + Au + H_2O + e^- \rightarrow HAuCl_4\ 4H_2$$

$$Na^+ + S + Au + H_2O + e^- \rightarrow Na_3Au(SO_3)_2\chi H_2O$$

It is believed that the influence of Cl on the protective film is different from that of Na. There is an opinion that on application of the voltage, the Cl ions form a fine hole or holes on the protective film in the positive direction or in the direction toward the conductor. On the other hand, the Na ions move relatively freely in the protective film (glass layer) and tend to be attracted in the negative direction or toward the platen roller 8 or heat-sensitive sheet 7. Therefore, the Na ions erode the surface of the protective film in the form of NaOH or the like.

In order to avoid such an electric erosion, it may be preferred that the bias voltage is not applied to the thermal head on non-printing. Depending on the specification of a device using such a thermal head, a common line for supplying a motor both with power and bias may be used in the thermal head. In such a case, the bias voltage may accidentally be applied to the thermal head on non-printing to create the electric erosion. The prior art thus has difficulty in completely preventing the electric erosion.

SUMMARY OF THE INVENTION

It is therefore an object of the present invention to provide a thermal head controller which can prevent an electric erosion from being created in the thermal head even if the bias voltage is applied to the thermal head on non-printing.

To this end, the present invention provides a thermal head control apparatus comprising means for applying a bias voltage to the heating resistance elements of a thermal head, drive means responsive to a print signal for selectively energizing the heating resistance elements when the bias voltage is applied to the thermal head by said bias applying means on printing, and means for moving a heat-sensitive medium relative to the thermal head in contact with the thermal head when the bias voltage is being applied to the heating resistance elements by the bias applying means on non-printing.

The electric erosion occurs on the application of bias under a condition of high temperature/humidity (e.g. 40° C. and 90%). When the bias voltage is being applied to the heating resistance elements on non-printing and if the heat-sensitive medium is moved relative to the thermal head by the moving means, the moisture on the surface of the heating resistance element can be modified to avoid the electric erosion. When the bias voltage is being applied to the heating resistance elements on non-printing and if the selected heating resistance element is intermittently energized by the energizing means to increase the temperature of the heating resistance element without coloring of the heat-sensitive medium, the moisture on the surface of the heating resistance element can be evaporated to avoid the electric erosion.

BRIEF DESCRIPTION OF THE INVENTION

DETAILED DESCRIPTION OF THE PREFERRED EMBODIMENTS

Figure 1:
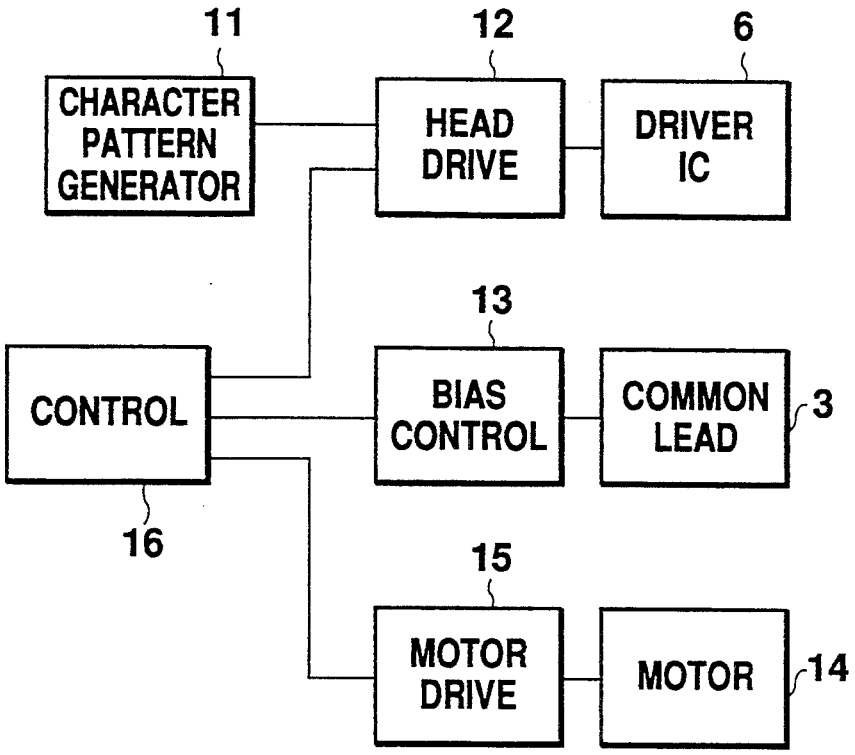
FIG. 1 is a block diagram of one embodiment of a thermal head controller constructed in accordance with the present invention.
Figure 4:
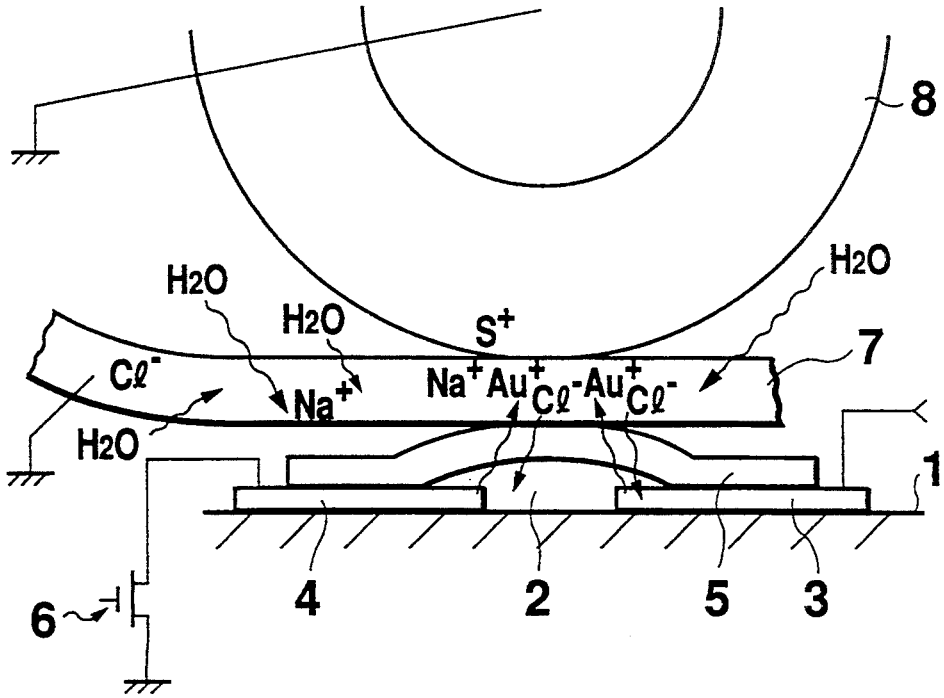
FIG. 4 illustrates the mechanism of electric erosion in the thermal head.

Referring to FIG. 1, there is shown one embodiment of a thermal head controller constructed in accordance with the present invention. The thermal head and its associated parts are similar to those of FIG. 4 and will not be further described herein.

The thermal head controller of the present invention comprises a driver IC 6 used as drive means responsive to a print signal for selectively energizing the resistance elements 2 (FIG. 4), a character pattern generator 11 for generating a character to be printed, a head drive circuit 12 for driving the driver IC 6 depending on a character pattern generated by the character pattern generator 11, a bias control circuit 13 for controlling the bias voltage, said bias control circuit 13 being connected to the common lead 3 of the thermal head, a motor 14 for rotatably driving the platen roller 8, a motor drive circuit 15 for energizing the motor 14, and a control circuit 16 for controlling the head drive circuit 12, bias control circuit 13 and motor drive circuit 15.

On printing, the motor 14 rotates the platen roller 8 to feed the heat-sensitive medium 7. The bias control circuit 13 applies a bias voltage (e.g. 24 volts) to each of the resistance elements 2 through the common lead 3. Under such a condition, the head drive circuit 12 drives the driver IC 6 depending on a character generated by the character pattern generator 11. As a result, the resistance elements 2 are selectively energized to color and print the heat-sensitive medium 7.

It is desirable that to avoid the electric erosion in the thermal head, even when the bias voltage is not applied to the thermal head on non-printing. However, a certain device may not avoid that a bias voltage is applied thereto on non-printing. The present invention can provide three different control modes to prevent the electric erosion from being created in the thermal head:

(a) The heat-sensitive medium 7 is delicately moved.

(b) Pulses not to color the heat-sensitive medium 7 (hereinafter called "preliminary pulses") are applied to the drive IC 6.

(c) The heat-sensitive medium 7 is delicately moved while at the same time the preliminary pulses are applied to the driver IC 6.

In the control mode (a), the heat-sensitive medium 7 is moved relative to the thermal head so that the moisture on the surfaces of the resistance elements 2 are changed at all times to avoid the electric erosion. In the control mode (b), the resistance elements 2 are heated sufficient not to color the heat-resistance medium 7 so that the moisture on the surfaces of the resistance elements 2 is evaporated. At the same time, the thermal head is temporarily placed in its non-bias state. Thus, the electric erosion can be avoided. The control mode (c) is provided by combining the control modes (a) and (b).

In the control modes (a) and (c), the movement of the heat-sensitive medium 7 is controlled by the control circuit 16 through the motor drive circuit 15. The speed of movement of the heat-sensitive medium 7 may be set to run several lines at about 7.7 dot lines/second.

In the control modes (b) and (c), preliminary pulses are generated by the head drive circuit 12 and then supplied to the driver IC 6 under the control of the control circuit 16.

Figure 2:
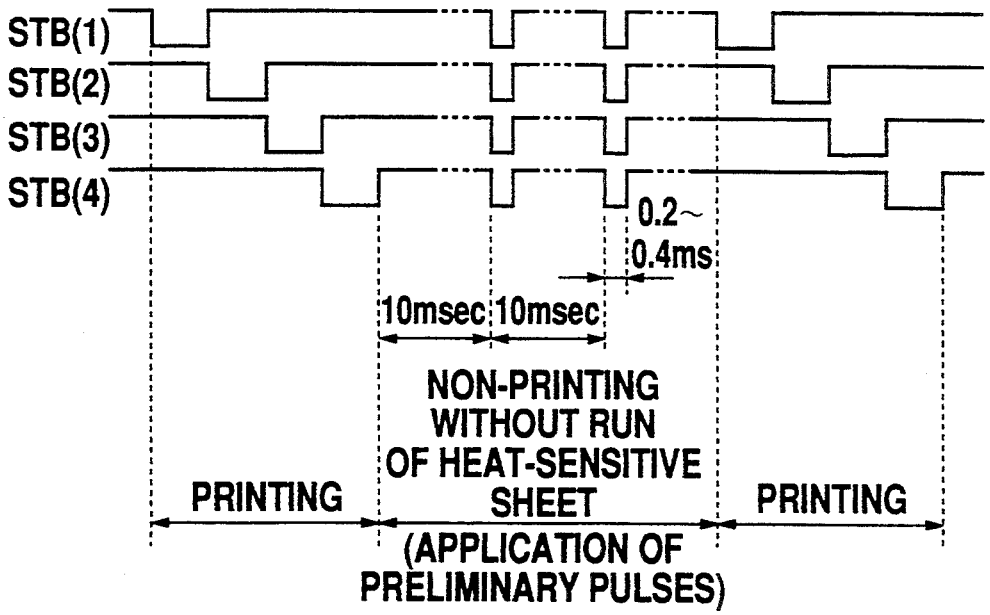
FIG. 2 is a timing chart illustrating an operation in the thermal head controller of FIG. 1.
Figure 3:
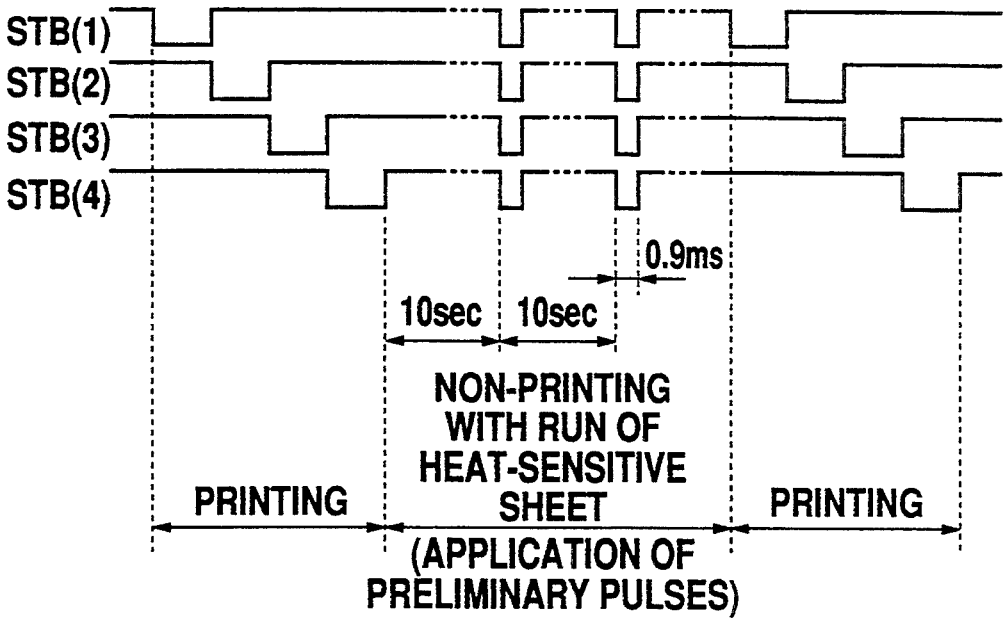
FIG. 3 is a timing chart illustrating another operation in the thermal head controller of FIG. 1.

FIG. 2 shows an example of the control mode (b) while FIG. 3 shows an example of the control mode (c). In these figures, strobe signals STB(1)–STB(4) are used to make four divided areas of the thermal head at their active states. On printing, each of the four divided thermal head areas is responsive to a print signal when the corresponding strobe signal is low.

As shown in FIGS. 2 and 3, the control mode (b) or (c) intermittently makes each strobe signal low to apply preliminary pulses to the thermal head on non-printing. However, the control mode (c) may provide the total energizing time period of the resistance elements 2 shorter than that of the control mode (b) since the heat-sensitive medium is moved in the control mode (c). In FIGS. 2 and 3, the control mode (b) applies the preliminary pulses to the thermal head for 0.2–0.4 milliseconds in a cycle of 10 milliseconds while the control mode (c) applies the preliminary pulses to the thermal head for 0.9 milliseconds in the cycle of 10 milliseconds. However, the present invention is not limited to such cases, but may be suitably set with respect to the preliminary pulses, depending on the thermal head and/or the specification of a device using the thermal head.

In accordance with the present invention, thus, any one of the control modes (a), (b) and (c) can be utilized to avoid the electric erosion in the thermal head.

The control mode (a) has an advantage in that it is more simple since only the heat-sensitive medium 7 is moved. The control mode (b) has an advantage in that it does not use any mechanical movable part. The control mode (c) can reduce the power consumption made by the application of preliminary pulses, in comparison to the control mode (b). Therefore, the control mode (c) is suitable for use in such a device that is importantly required to be constructed into a portable form and to be operated more efficiently.

As will be apparent from the foregoing, the present invention can avoid the electric erosion in the thermal head even if a bias voltage is being applied to the thermal head on non-printing, by moving the heat-sensitive medium relative to the thermal head or intermittently energizing the heating resistance elements such that the heat-sensitive medium will not be colored.

We claim:

1. An apparatus for controlling a thermal head, comprising means for applying a bias voltage to heating resistance elements of the thermal head, drive means responsive to a print signal for selectively energizing the heating resistance elements when the bias voltage is applied to the thermal head by said bias voltage applying means on printing, and means for moving a heat-sensitive medium relative to the thermal head in contact with the thermal head when the bias voltage is being applied to the heating resistance elements by the bias voltage applying means on non-printing.

2. An apparatus as defined in claim 1 wherein a speed of movement of the heat-sensitive medium performed by said moving means is at least 7.7 dot lines/second.

3. An apparatus for controlling a thermal head, comprising means for applying a bias voltage to heating resistance elements of the thermal head, drive means responsive to a print signal for selectively energizing the heating resistance elements when the bias voltage is applied to the thermal head by said bias voltage applying means on printing, and means for moving a heat-sensitive medium relative to the thermal head in contact with the thermal head when the bias voltage is being applied to the heating resistance elements by the bias voltage applying means on non-printing, and means for intermittently energizing selected heating resistance elements to increase a temperature of a heating resistance element without coloring of said heat-sensitive medium when the bias voltage is being applied to the heating resistance elements by the bias voltage applying means on non-printing.

4. An apparatus as defined in claim 3 wherein the energization in said drive means is performed for 0.9 milliseconds in a cycle of at least 10 seconds.

5. An apparatus as defined in claim 3 wherein a speed of movement of the heat-sensitive medium performed by said moving means is at least 7.7 dot lines/second.

* * * * *